United States Patent [19]

Hossalla et al.

[11] 4,084,703

[45] Apr. 18, 1978

[54] REFRIGERATION SHELF

[75] Inventors: George J. Hossalla, Shoreview; Norman R. Stein, St. Louis Park, both of Minn.

[73] Assignee: Stein Industries, Inc., Minneapolis, Minn.

[21] Appl. No.: 757,455

[22] Filed: Jan. 6, 1977

[51] Int. Cl.[2] ..... A47B 96/02; A47F 5/00

[52] U.S. Cl. ..... 211/153; 108/137; 312/313

[58] Field of Search ..... 312/304, 312, 313, 330; 108/137, 143; 211/143, 151, 153; 62/252, 254

[56] References Cited

U.S. PATENT DOCUMENTS

| | | | |
|---|---|---|---|
| 2,319,470 | 5/1943 | Nobles | 211/153 |
| 2,745,705 | 5/1956 | Morgan | 108/143 |
| 2,849,123 | 8/1958 | Magill | 211/153 |
| 3,625,371 | 12/1971 | Dill | 211/153 |
| 3,908,563 | 9/1975 | Eckart, Jr. | 211/153 |
| 3,986,616 | 10/1976 | Gray | 211/153 |

*Primary Examiner*—Casmir A. Nunberg
*Attorney, Agent, or Firm*—Jacobson and Johnson

[57] ABSTRACT

An adjustable refrigeration shelf is provided having means for directing cold air onto the goods on the shelf and means for holding the goods in a highly visible position within the refrigeration unit.

1 Claim, 2 Drawing Figures

REFRIGERATION SHELF

BACKGROUND OF THE INVENTION

1. Field of the Invention

This invention relates generally to shelves and, more specifically, to adjustable storage shelves for use in the refrigerated food industry.

2. Description of the Prior Art

The concept of shelves and slidable shelves for a refrigerator are old in the art as evidenced by the Kesling U.S. Pat. No. 3,334,954 which discloses a refrigerator shelf which slides into another half shelf to allow tall articles, such as bottles, to be placed on a lower shelf of the refrigerator.

The Sheer U.S. Pat. No. 1,504,522 and the Pattison U.S. Pat. No. 3,311,072 both show shelves which are slidably supported by stationary frames mounted to the cabinets. The Hall et al U.S. Pat. No. 2,241,854 has shelves which are made of perforated material and provided with a lip at the end of the shelf. Still another prior art patent is the Williams et al U.S. Pat. No. 2,601,652 which discloses a refrigerator shelf having a baffle under a display screen, the baffle aiding in air circulation in the cabinet.

The Weber U.S. Pat. No. 2,836,039 shows a refrigerated self-storage case having rigid shelves for holding articles in the case. The Dill U.S. Pat. No. 3,625,371 shows a shelf with a removable front panel for freezer use.

From a review of these prior art patents, it is apparent that the present invention comprises an improvement for use in commercial refrigeration storage cases by providing an adjustable shelf which accommodates different size refrigeration units as well as providing means for cooling the goods located on the shelf. The shelf also includes means for holding the goods in a highly visible position so it can be readily seen by a purchaser.

BRIEF SUMMARY OF THE INVENTION

Briefly, the present invention comprises a two portion shelf having a first section that mates to a second section with interlocking members located on the edges of the shelf as well as in the interior of the shelf. The interlocking members provide means for extending the shelf to a desired length. The interlocking members, while providing sliding adjustment, provide support in four places of the shelf to provide a rigid shelf. A further aspect of the invention is the foraminous feature of the shelf material as well as the foraminous ledge which allows for displaying goods thereon.

DESCRIPTION OF THE PREFERRED EMBODIMENT

Figure 1:
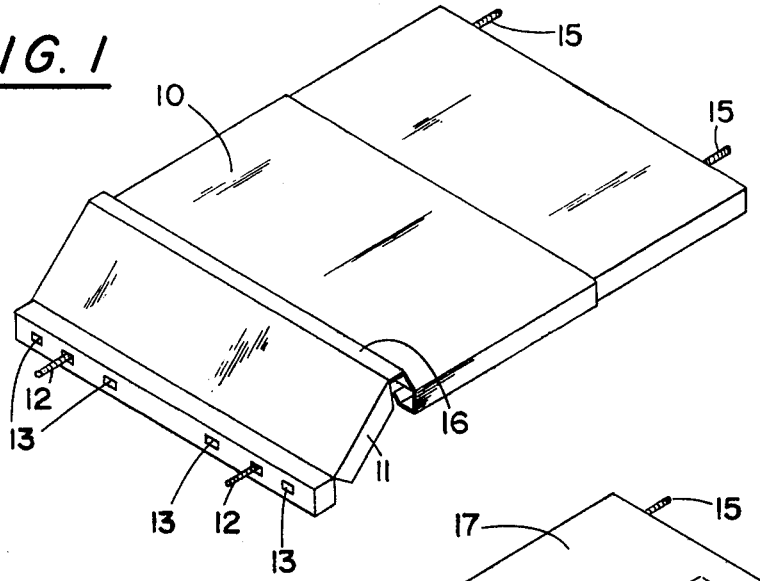
FIG. 1 is a perspective view of the shelf.
Figure 2:
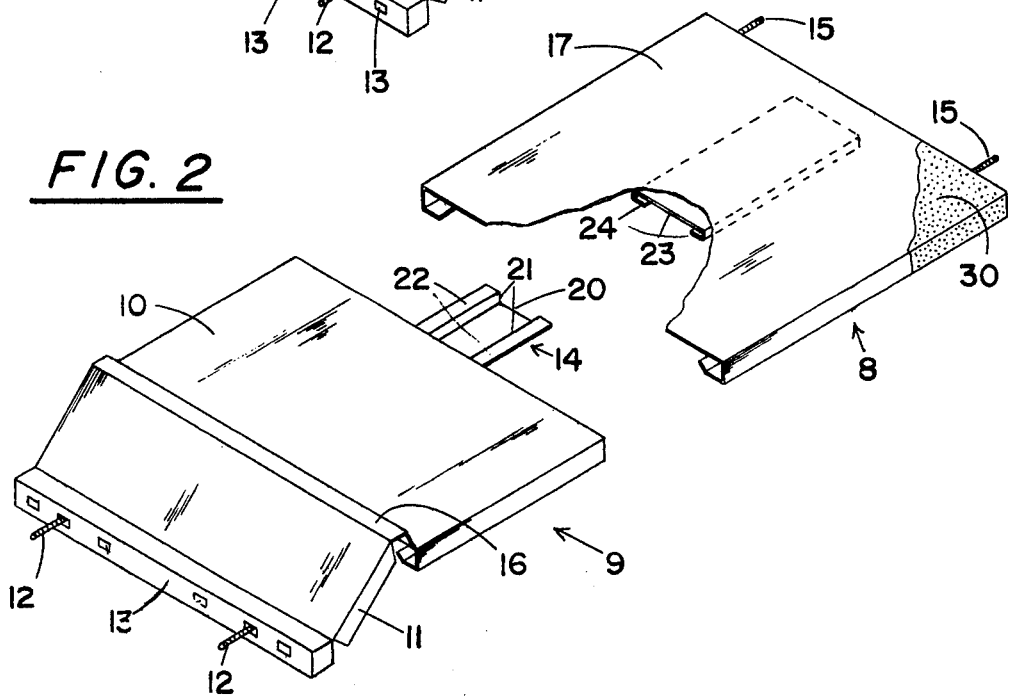
FIG. 2 is an exploded view of the shelf.

Referring to FIGS. 1 and 2, reference numerals 8 and 9 designate the foraminous adjustable shelf for holding and displaying goods in a refrigerated storage case. Preferably, the shelf is made of a perforated anodized aluminum with openings on the order of 0.010 inch to 0.015 inch in diameter. The shelf comprises a front section 9 that slidingly engages a back section 8. Front section 9 has a flat horizontal surface 10 with a ridge 16 and an angled front surface 11 formed from a continuous sheet of material. Front section 10 is mounted to the refrigeration case through bolts 12 which are placed in openings in member 13. Similarly, rear section 8 has bolts 15 for attaching to the rear of the refrigeration case. Front section 9 and rear section 8 are located in slidable engagement through two sets of fastening members. The outer U-shaped edges of section 8 slide into the larger U-shaped edges in member 9. Located in the center of the first section 9 is a second U-shaped member 14 having horizontal edges 22, vertical members 21 and a horizontal member 20. Attached to rear section 8 is a member 23 having lips 24 that extend toward the center of the shelf. Lips 24 are sufficiently spaced from member 23 to allow edges 22 to slide therebetween. Thus the present shelf allows for sliding of the rear section 8 into the forward section to shorten the shelf to the desired length. As the edge portions of both the shelves and the central members contain supports located at right angles to one another, the supports are sufficiently rigid to prevent sagging or movement of the shelf.

Typically, our expandable shelf provides a support shelf ranging from 29 inches to 41 inches so that it can be installed in most refrigeration units. In the preferred embodiment, aluminum, which has been anodized green, is used as it provides a fresh look to the shelf.

Reference numeral 30 designates the foraminous nature of the shelf, which for illustration purposes, is shown only in a corner of section 8. However, the openings are located throughout the shelf as the material used to make the shelf contains the openings which in the preferred embodiment are circular.

We claim:

1. An adjustable display shelf for use in a variety of refrigeration units comprising: a first foraminous section, said first section having at least two surfaces for supporting goods thereon; one of said surfaces adaptable for mounting in a horizontal position with the other surface located at an angle to the horizontal to thereby allow for produce to be stacked thereon; a ridge located on said first section, said ridge operable for holding goods in a highly visible position on said horizontal section, said ridge separating said horizontal surface from said surface located at an angle to the horizontal; said first section having members formed to receive a second section; said members located at the edges of said first section and intermediate of the edges of said first section and said second section; a second foraminous section, said second section having a goods supporting surface, said second section further having members formed for sliding engagement with said first section so that said first section and said second section are positionable with respect to one another to thereby allow the adjustable shelf to be used in a variety of refrigeration units; said first section having means located at one end for engaging one side of a refrigeration unit, said second section having means located at one end for engaging the opposite side of a refrigeration unit.

* * * * *